US005944129A

United States Patent [19]

Jensen

[11] Patent Number: 5,944,129

[45] Date of Patent: Aug. 31, 1999

[54] SURFACE FINISH FOR NON-PLANAR INSERTS

[75] Inventor: Kenneth M. Jensen, Orem, Utah

[73] Assignee: U.S. Synthetic Corporation, Orem, Utah

[21] Appl. No.: 08/980,499

[22] Filed: Nov. 28, 1997

[51] Int. Cl.[6] ..... E21B 10/46

[52] U.S. Cl. ..... 175/430; 175/432; 175/434

[58] Field of Search ..... 175/426, 428, 175/430, 432, 434

[56] References Cited

U.S. PATENT DOCUMENTS

| | | | |
|---|---|---|---|
| 4,109,737 | 8/1978 | Bovenkerk | 175/329 |
| 4,604,106 | 8/1986 | Hall et al. | 51/293 |
| 4,694,918 | 9/1987 | Hall | 175/329 |
| 4,858,707 | 8/1989 | Jones et al. | 175/329 |
| 4,997,049 | 3/1991 | Tank et al. | 175/410 |
| 5,154,245 | 10/1992 | Waldenstrom et al. | 175/420.2 |
| 5,217,081 | 6/1993 | Waldenstrom et al. | 175/420.2 |
| 5,264,283 | 11/1993 | Waldenstrom et al. | 428/408 |
| 5,304,342 | 4/1994 | Hall et al. | 419/11 |
| 5,335,738 | 8/1994 | Waldenstrom et al. | 175/420.2 |
| 5,370,195 | 12/1994 | Keshavan et al. | 175/420.2 |
| 5,379,854 | 1/1995 | Dennis | 175/434 |
| 5,447,208 | 9/1995 | Lund et al. | 175/428 |
| 5,544,713 | 8/1996 | Dennis | 175/434 |
| 5,624,068 | 4/1997 | Waldenstrom et al. | 228/262.21 |
| 5,653,300 | 8/1997 | Lund et al. | 175/428 |
| 5,706,906 | 1/1998 | Jurewicz et al. | 175/428 |

*Primary Examiner*—Roger Schoeppel
*Attorney, Agent, or Firm*—Lloyd W. Sadler

[57] ABSTRACT

An improved surface finish for non-planar drill inserts or cutting elements is provided for use on inserts used in the drilling and boring of subterranean rock formations. This new surface finish provides an insert with improved wear characteristics, a decrease in heat generation, a decrease in frictional work loss, and a minimization of failure inducting surface cracks. This invention accomplishes these objectives by a process of polishing the cutting or contact surface of the insert to a very high degree of smoothness.

13 Claims, 4 Drawing Sheets

SURFACE FINISH FOR NON-PLANAR INSERTS

BACKGROUND OF THE INVENTION

1. Field of the Invention

This invention relates to devices for drilling and boring through subterranean formations. More specifically, this invention relates to polycrystailine diamond compacts ("PDCs"), also known as cutting elements or diamond inserts, which are intended to be installed as the cutting element of a drill bit to be used for boring through rock for many applications, including oil, gas, mining, and/or geothermal exploration, that require drilling through geological formations. Still more specifically, this invention relates to polycrystalline diamond inserts which have a surface topography formed integral to an otherwise spherical, conical, or other uniform geometric shape, to increase stress at the insert/rock interface, thereby inducing the rock to fail with the expenditure of less overall energy while introducing little additional internal stresses to the insert.

2. Description of Related Art

Three types of drill bits are most commonly used in penetrating geologic formations. These are: (1) percussion bits; (2) rolling cone bits, also referred to as rock bits; and (3) drag bits, or fixed cutter rotary bits. Each of these types of bits may employ the polycrystalline diamond inserts of this invention as the primary cutting device.

In addition to the drill bits discussed above, polycrystalline diamond inserts may also be used with other down hole tools, including but not limited to: reamers, stabilizers, and tool joints. Similar devices used in the mining industry may also use this invention.

Percussion bits penetrate through subterranean geologic formations by an extremely rapid series of impacts. The impacts may be combined with simultaneous rotations of the bit. An exemplary percussion bit is shown in FIG. 1*b*. The reader is directed to the following list of related art patents for further discussion of percussion bits.

Rolling cone bits currently make up the largest number of bits used in drilling geologic formations. Rolling cone bits have as their primary advantage the ability to penetrate hard geologic formations while still being generally available at a relatively low cost. Typically, rolling cone bits operate by rotating three cones, each oriented substantially transverse to the bits axis and in a triangular arrangement, with the narrow end of each cone facing a point in the direct center of the bit. An exemplary rolling cone bit is shown in FIG. 1*a*.

A rolling cone bit cuts through rock by the crushing and scraping action of the abrasive inserts embedded in the surface of the rotating cone. These abrasive inserts are generally composed of cemented tungsten carbide, but may also include polycrystalline diamond coated cemented tungsten carbide insert of this invention, where increased wear performance is required.

The primary application of this PDC invention is currently believed to be in connection with percussion and rolling cone bits, although alternative embodiments of this invention may find application in connection with other drilling tools.

A third type of bit is the drag bit, known also as the fixed cutter bit. An example of a drag bit is shown in FIG. 2. The drag bit is designed to be rotated about its longitudinal axis. Most drag bits employ PDCs which are brazed into the cutting blade of the bit. The PDCs then shear the rock as the bit is rotated about its longitudinal axis.

It is expected that this invention will find primary application in percussion and rolling cone bits, although some use in drag bits may also be feasible.

A polycrystalline diamond compact ("PDC"), or cutting element, is typically fabricated by placing a cemented tungsten carbide substrate into a refractory metal container ("can") with a layer of diamond crystal powder placed into the can adjacent to one face of the substrate. The can is then covered. A number of such can assemblies are loaded into a high pressure cell made from a soft ductile solid material such as pyrophyllite or talc. The loaded high pressure cell is then placed in an ultra-high pressure press. The entire assembly is compressed under ultra-high pressure and ultra-high temperature conditions. This compression causes the metal binder from the cemented carbide substrate to become liquid and to "sweep" from the substrate face through the diamond grains and to act as a reactive liquid phase promoting the sintering of the diamond grains. Sintering of the diamond grains cause the formation of a polycrystalline diamond structure. As a result the diamond grains become mutually bonded together to form a diamond mass over the substrate face. The metal binder may remain in the diamond layer within the pores of the polycrystalline structure or, alternatively, it may be removed via acid leeching and optionally replaced by another material forming so-called thermally stable diamond ("TSD"). Variations of this general process exist and are described in the related art. This detail is provided so the reader may become familiar with the concept of sintering a diamond layer onto a substrate to form a PDC insert. For more information concerning this process, the reader is directed to U.S. Pat. No. 3,745,623, issued to Wentorf Jr. et al., on Jul. 7, 1973.

Many existing art PDCs exhibit durability problems in cutting through tough geologic formations, where the diamond working surface can experience high stress loads which may be transient in nature. Under such conditions, typical PDCs have a tendency to crack, spall, and break. Similarly, existing PDCs are relatively weak when placed under high loads from a variety of angles. These problems of existing PDCs are further exacerbated by the dynamic nature of both normal and torsional loading during the drilling process, during which the bit face moves into and out of contact with the uncut material forming the bottom of the well bore.

For optimal performance, the interface between the diamond layer and the tungsten carbide substrate must be capable of sustaining the high residual stresses that arise from the thermal expansion and bulk modulus mismatches between the two materials. These mismatches can create high residual stress at the interface as the materials are cooled from the high temperature and pressure process. Residual stress can be deleterious to the life of the PDC cutting elements, or inserts, during drilling operations, when high tensile stresses in the substrate or diamond layer may cause fracture, spalling, or complete delamination of the diamond layer from the substrate.

Diamond is used as a drilling material primarily because of its extreme hardness and abrasion resistance. However, diamond also has a major drawback. Diamond, as a cutting material, has very poor toughness, that is, it is very brittle. Therefore, anything that contributes to further reducing the toughness of the diamond, substantially degrades its durability.

A number of other approaches and applications of PDCs are well established in related art. The applicant includes the following references to related art patents for the reader's general familiarization with this technology.

U.S. Pat. No. 4,109,737 describes a rotary drill bit for rock drilling comprising a plurality of cutting elements mounted by interference-fit in recesses in the crown of the drill bit.

U.S. Pat. No. 4,604,106 reveals a composite polycrystalline diamond compact comprising at least one layer of diamond crystals and precemented carbide pieces which have been pressed under sufficient heat and pressure to create composite polycrystalline material wherein polycrystalline diamond and the precemented carbide pieces are interspersed in one another.

U.S. Pat. No. 4,694,918 describes an insert that has a tungsten carbide body and at least two layers at the protruding drilling portion of the insert. The outermost layer contains polycrystalline diamond and the remaining layers adjacent to the polycrystalline diamond layer are transition layers containing a composite of diamond crystals and precemented tungsten carbide, the composite having a higher diamond crystal content adjacent to the polycrystalline diamond layer and a higher precemented tungsten carbide content adjacent to the tungsten carbide layer.

U.S. Pat. No. 4,858,707 describes a diamond insert for a rotary drag bit consists of an insert stud body that forms a first base end and a second cutter end.

U.S. Pat. No. 4,997,049 describes a tool insert having a cemented carbide substrate with a recess formed in one end of the substrate and having abrasive compacts located in the recesses and bonded to the substrate.

U.S. Pat. No. 5,154,023 describes a process for polishing refractory materials, including natural and synthetic diamond, wherein the surfaces are successively softened to a predetermined depth by io implantation, followed by mechanical polishing.

U.S. Pat. No. 5,154,245 relates to a rock bit insert of cemented carbide for percussive or rotary crushing rock drilling. The button insert is provided with one or more bodies of polycrystalline diamond in the surface produced by high pressure and high temperature in the diamond stable area. Each diamond body is completely surrounded by cemented carbide except the top surface.

U.S. Pat. No. 5,217,081 relates to a rock bit insert of cemented carbide provided with one or more bodies or layers of diamond and/or cubic boron nitride produced at high pressure and high temperature in the diamond or cubic boron nitride stable area. The body of cemented carbide has a multi-structure containing eta-phase surrounded by a surface zone of cemented carbide free of eta-phase and having a low content of cobalt in the surface and a higher content of cobalt next to the eta-phase zone.

U.S. Pat. No. 5,264,283 relates to buttons, inserts and bodies that comprise cemented carbide provided with bodies and/or layers of CVD- or PVD-fabricated diamond and then high pressure/high temperature treated in the diamond stable area.

U.S. Pat. No. 5,304,342 describes a sintered product useful for abrasion- and impact-resistant tools and the like, comprising an iron-group metal binder and refractory metal carbide particles.

U.S. Pat. No. 5,335,738 relates to a button of cemented carbide. The button is provided with a layer of diamond produced at high pressure and high temperature in the diamond stable area. The cemented carbide has a multi-phase structure having a core that contains eta-phase surrounded by a surface zone of cemented carbide free of eta-phase.

U.S. Pat. No. 5,370,195 describes a drill bit having a means for connecting the bit to a drill string and a plurality of inserts at the other end for crushing the rock to be drilled, where the inserts have a cemented tungsten carbide body partially embedded in the drill bit and at least two layers at the protruding drilling portion of the insert. The outermost layer contains polycrystalline diamond and particles of carbide or carbonitride.

U.S. Pat. No. 5,379,854 discloses a cutting element which has a metal carbide stud with a plurality of ridges formed in a reduced or full diameter hemispherical outer end portion of said metal carbide stud. The ridges extend outwardly beyond the outer end portion of the metal carbide stud. A layer of polycrystalline material, resistant to corrosive and abrasive materials, is disposed over the ridges and the outer end portion of the metal carbide stud to form a hemispherical cap.

U.S. Pat. No. 5,447,208 describes a cutting element having a polished, low friction substantially planar cutting face with a surface finish roughness of 10 mu inch or less and preferably 0.5 mu inch or less.

U.S. Pat. No. 5,544,713 discloses a cutting element with a metal carbide stud that has a conic tip formed with a reduced diameter hemispherical outer tip end portion of said metal carbide stud. A corrosive and abrasive resistant polycrystalline material layer is also disposed over the outer end portion of the metal carbide stud to form a cap, and an alternate conic form has a flat tip face. A chisel insert has a transecting edge and opposing flat faces, which chisel insert is also covered with a polycrystalline diamond compact layer.

U.S. Pat. No. 5,624,068 describes buttons, inserts and bodies for rock drilling, rock cutting, metal cutting and wear part applications, where the buttons or inserts or bodies comprise cemented carbide provided with bodies and/or layers of CVD- or PVD-fabricated diamond and then HP/HT treated in a diamond stable area.

U.S. Pat. No. 5,653,300 describes a superhard cutting element having a polished, low friction substantially planar cutting face with a surface finish roughness of 10 mu inch or less and preferably 0.5 mu inch or less. A chamfered cutting edge and side surface of the superhard material table of the same surface finish roughness are also disclosed.

Each of the aforementioned patents and elements of related art is hereby incorporated by referenced in its entirety for the material disclosed therein.

SUMMARY OF THE INVENTION

It is desirable to provide an insert, for use in drill bits which are used to bore through subterranean geologic formation, which has increased durability. This invention provides this increased durability through an improved surface finish created through polishing of the diamond surface. An insert with a polished diamond surface leads to improved durability of the insert by decreasing the coefficient of friction at the insert/rock interface, thereby decreasing the generation of heat within the insert; decreasing the frictional work losses of the insert; and decreasing the quantity of cracks at the diamond surface. Surface cracks tend to propagate during cutting of the rock, leading to early cutter failure. Improved surface finish also reduces the crack formation due to uneven contact stresses.

Therefor, it is an object of this invention to improve insert durability by improving the surface finish of the diamond surface of the insert.

It is a further object of this invention to provide a diamond drill insert with an decreased coefficient of friction at the surface of the diamond layer.

It is a further object of this invention to provide a diamond drill insert with decreased internal heat generation characteristics.

It is a further object of this invention to provide a diamond drill insert with a reduced number of surface cracks at the surface of the diamond layer.

These and other objects, features and advantages of this invention, will be readily apparent to those of ordinary skill in the art upon review of the following drawings, description and claims of this patent application, and are achieved by the invention as described in this application.

DETAILED DESCRIPTION OF THE INVENTION

Figure 1A:
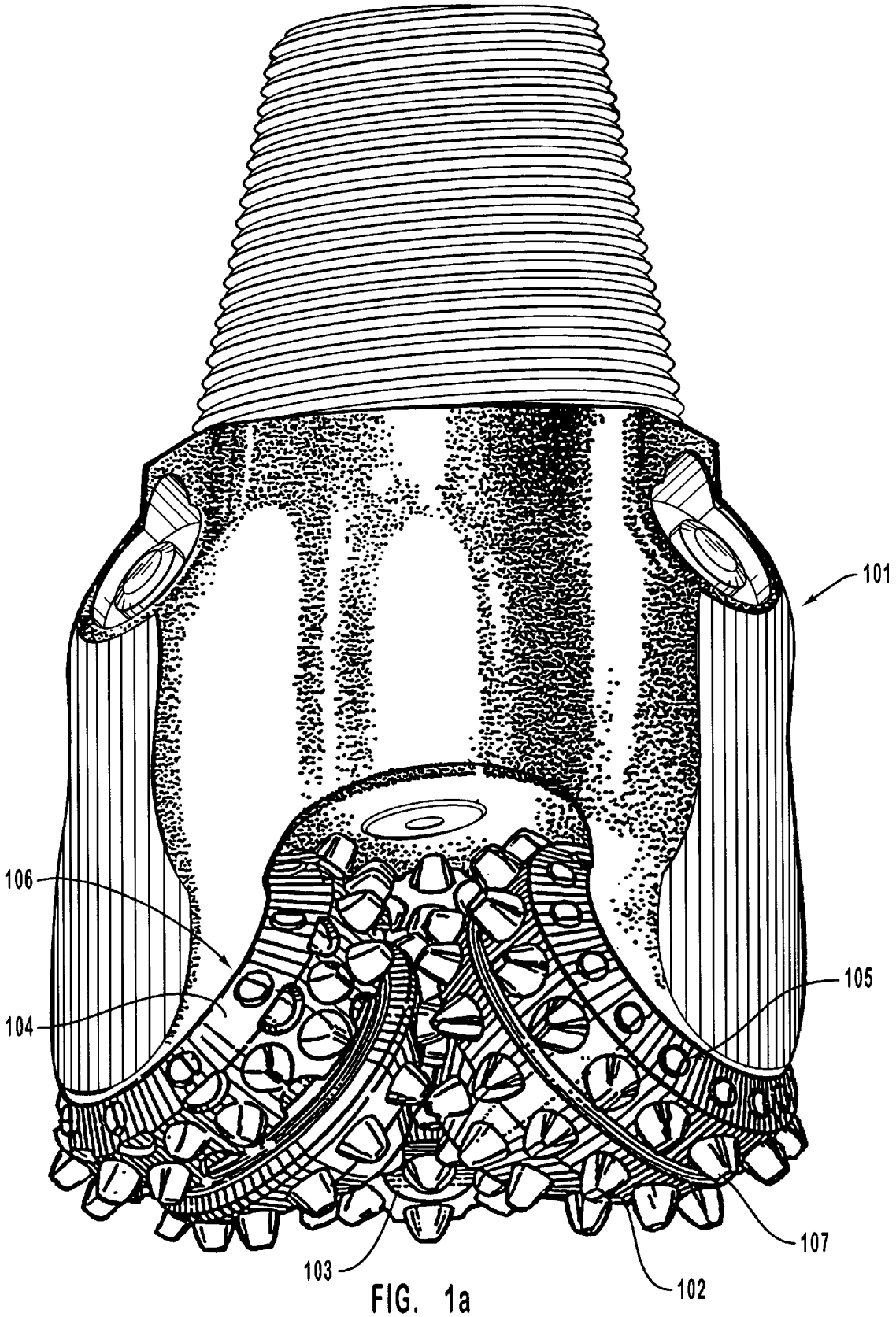
FIG. 1a (Prior Art)
FIG. 1*a* depicts an exemplary related art roller cone earth boring bit.
Figure 1B:
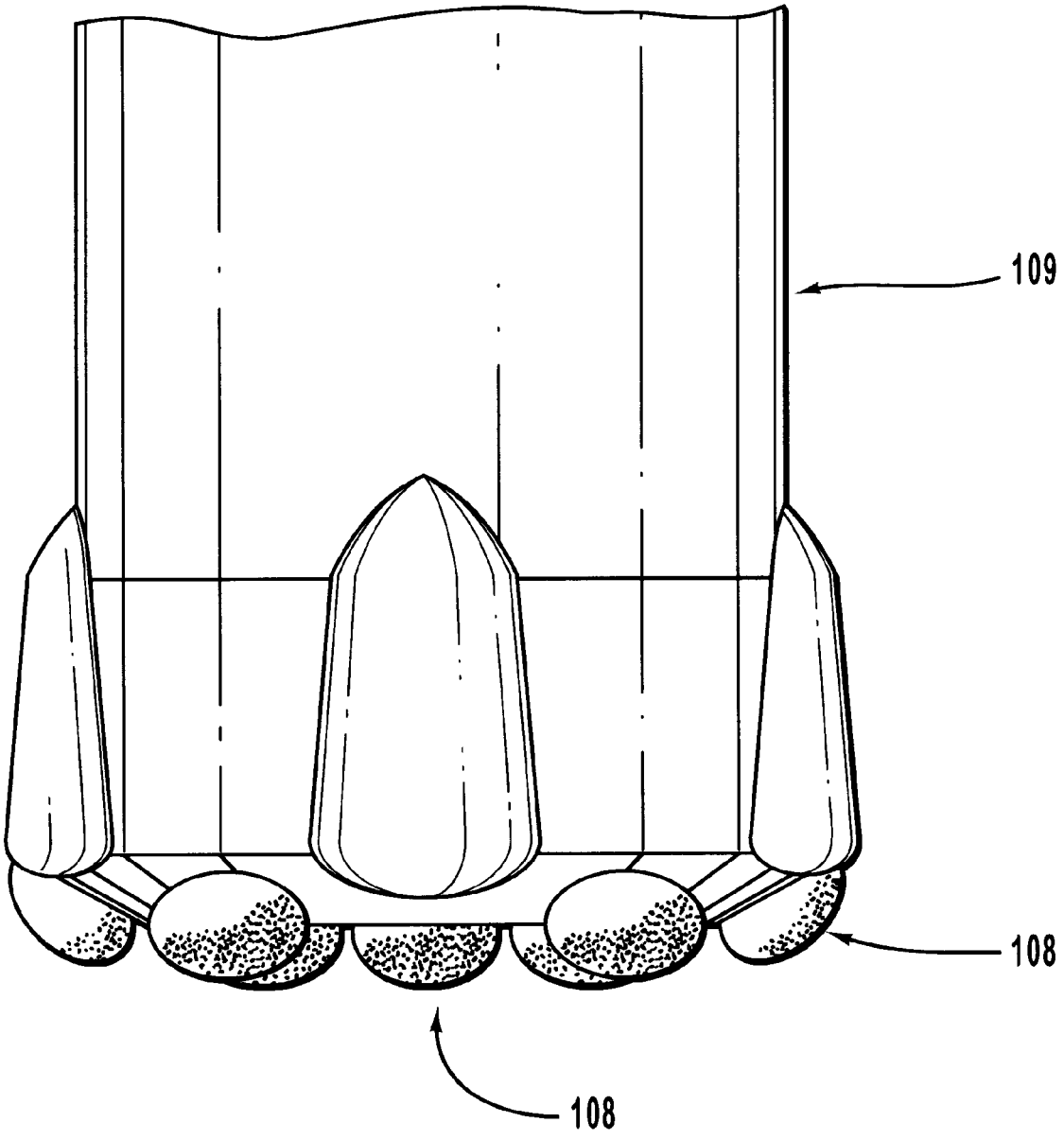
FIG. 1b (Prior Art)
FIG. 1*b* depicts an exemplary related art percussion bit.

This invention is intended for use on non-planar drill inserts which are used in cutting tools, most typically roller cone bits, as shown in FIG. 1*a*, and percussion bits, as shown in FIG. 1*b*. The typical roller cone bit 101 includes three rotating cones 102, 103, 104. Each rotating cone 102, 103, 104 includes a plurality of cutting teeth 107. The polycrystalline diamond inserts of this invention are designed for use as the cutting teeth 107. Each insert (also known as a drill insert) is press fit into the drill bit such that the drill bit 101 such that the diamond surface is exposed outside the bit. FIG. 1*b* shows a standard percussion bit 109 for use in percussion rock drilling, which is provided with cemented carbide button drill inserts 108. The polished diamond inserts of this invention can be used in the place of the carbide button inserts 108 of the percussion bit 109.

Figure 2:
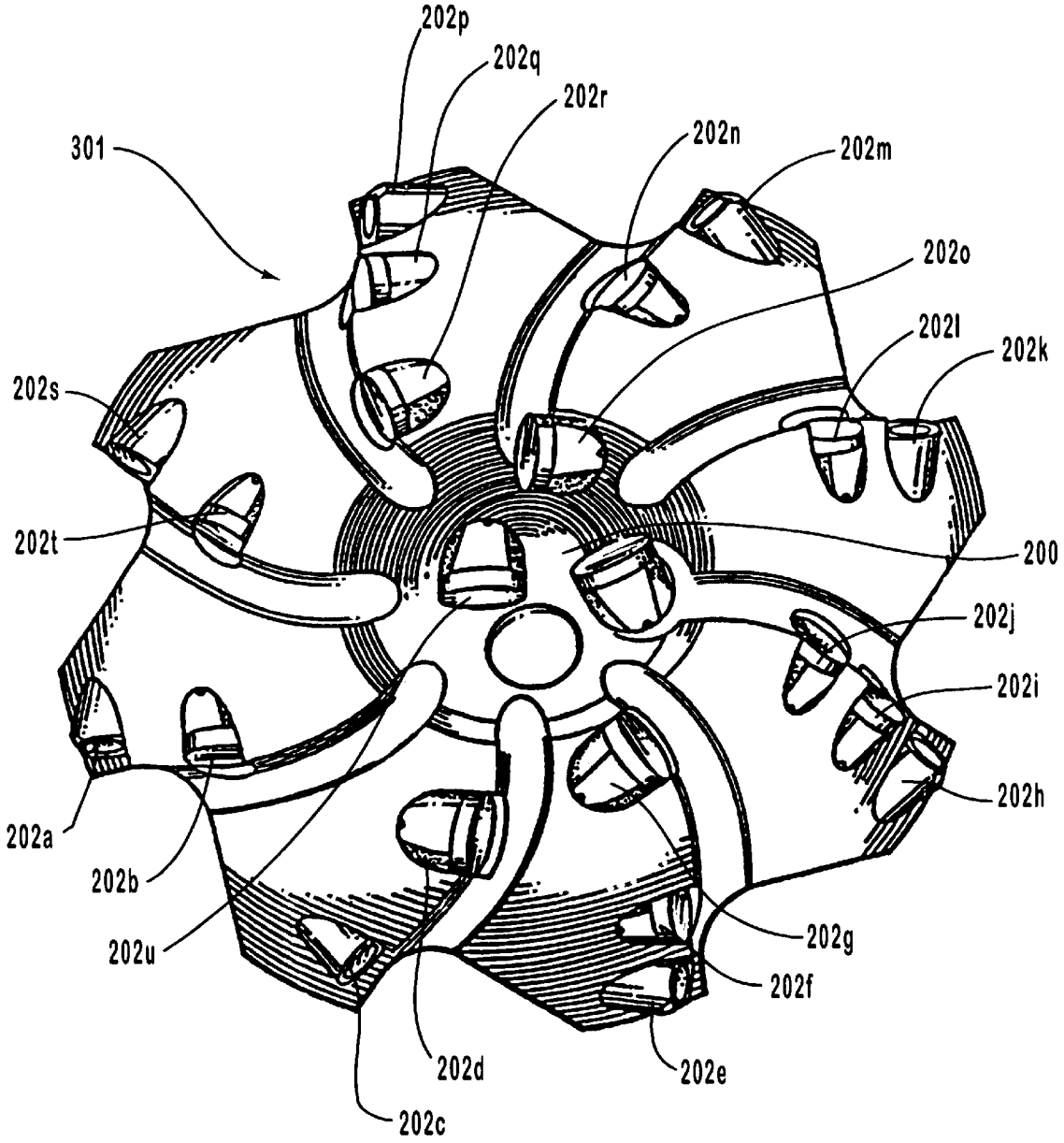
FIG. 2 (Prior Art)
FIG. 2 depicts an exemplary related art drag or fixed cutter bit.

FIG. 2 depicts the side view of an example of a typical drag bit 201. A number of inserts, which could be of the type described in this invention are shown 201*a–t* arranged in rows emanating in a generally radial fashion from the approximate center 205 of the bit. It is expected by the inventor that inserts using the improved surface finish of this invention could be used on rolling cone, percussion and drag bits of virtually any configuration.

In each embodiment of this invention the insert is composed of essentially two materials: polycrystalline diamond, which covers the cutting or contact surface of the insert; and tungsten carbide. The tungsten carbide region is the area of the insert that is brazed into the bit body, while the polycrystalline diamond region is the area of the inset that comes in contact with the geologic formation during the drilling operation. In the present invention, an improved surface finish is provided for non-planar insert (also known as "cutters"). The improved surface finish decreases friction at the insert/rock interface, thereby decreasing the amount of heat generated as well as decreasing the frictional work losses in the drilling operation. Also, by virtue of improving the surface finish, the quantity of cracks in the surface is reduced. Cracks may otherwise propagate and can cause the failure of the insert. The propensity of cracks to form at the surface is also reduced. This reduction is due to the improved distribution of stresses across a polished surface.

The inserts with the improved surface finish of this invention, although typically constructed with polycrystalline diamond on a tungsten carbide substrate, can use other materials, such as cubic boron nitride or some other superabrasive material in place of the polycrystalline diamond. Similarly, titanium carbide, tantalum carbide, vandium carbide, niobium carbide, hafnium carbide, or zirconium carbide may be used in place of the tungsten carbide as the substrate material. Such superabrasive materials and substrate materials suitable for use in inserts are well known in the art.

Typically inserts employing the surface finish of this invention are formed by sintering the diamond layer under high temperature and pressure conditions to the substrate, using a metal binder or reactive liquid phase such as cobalt. The substrate may be brazed or otherwise joined to an attachment member such as a stud or to a cylindrical backing element to enhance its affixation to the bit face. The insert element may be mounted to a drill bit either by press-fitting or otherwise locking the stud into a receptacle on a steel-body drag bit, percussion or roller cone bit, or by brazing the insert substrate (with or without cylindrical backing) directly into a preformed pocket, socket or other receptacle on the face of the bit body as on a matrix-type bit.

A insert having the surface finish of this invention, is typically fabricated by placing a preformed cemented carbide substrate into a container or cartridge with a layer of diamond or grains loaded into the cartridge adjacent to one face of the substrate. A number of such cartridges may be loaded into an ultra-high pressure press. The substrates and adjacent diamond crystal layers are then subjected to ultra-high temperature and pressure conditions. The ultra-high pressure and temperature conditions cause the metal binder from the substrate body to become liquid and to sweep from the region behind the substrate face next to the diamond layer, through the diamond grains and then to act as a reactive liquid phase to promote the sintering of the diamond grains to form the polycrystalline diamond structure. As a result, the diamond grains become mutually bonded to form a diamond mass over the substrate face, which diamond mass is also bonded to the substrate face. Alternatively, the diamond layer may be formed as above, but separately from the substrate, and may subsequently be bonded to the substrate material by brazing with a tungsten or titanium-base braze. Yet another alternative method is to deposit the diamond layer on the substrate by chemical vapor deposition (CVD) processing. The metal binder may remain in the diamond layer within the pores existing between the diamond grains or may be removed and optionally replaced by another material, as known in the art, to form a so-called thermally stable diamond. The binder is removed by leaching or the diamond table is formed with silicon, a material having a coefficient of thermal expansion similar to that of diamond. Variations of this general process exist in the art, but this detail is provided so that the reader will understand the concept of sintering a diamond layer onto a substrate in order to form a cutter or insert.

In the case of the present invention, once the desired surface shape of the diamond layer is achieved, a polishing finish is applied. A variety of polishing methods may be employed to achieve the desired finish, including diamond grinding, EDG, chemical polishing, laser polishing and honing. Additional equivalent methods of polishing diamond could be adapted to work with non-planar cutter surfaces.

In the current best mode of this invention the polishing is performed by grinding using fine-grit diamond wheels to achieve a highly polished surface. Either manual or automatic equipment may be used to polish the chosen geometry. The machines used will cause the desired final geometry to be formed as the polishing takes place.

Figure 3A:
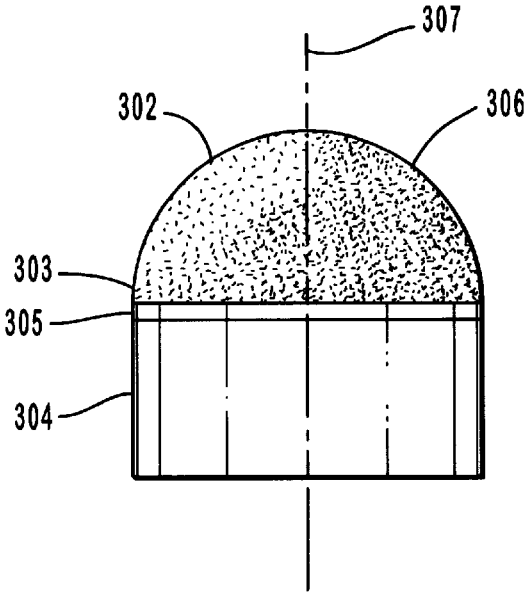
FIG. 3 depicts a first preferred embodiment of the invention showing the polished surface of the diamond insert.
Figure 3B:
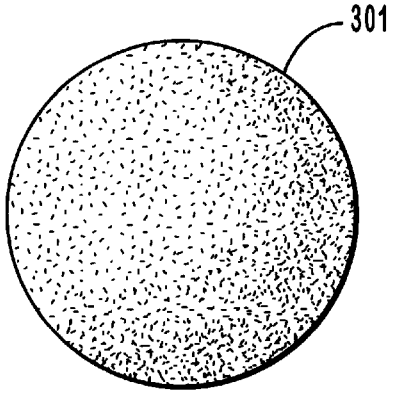

FIG. 3 depicts the top 301 and side 302 view of a single preferred embodiment of the invention. It can be seen that inserts of this invention are generally cylindrical in shape, with a generally hemispherical diamond surface 306, the apex of which is at the center axis 307 of the insert. This diamond insert is composed of layer of polycrystalline diamond 303 bonded to a tungsten carbide substrate 304. The polycrystalline diamond layer 303 serves as the cutting, or contact surface, with the surface of the polycrystalline diamond layer polished to a very high degree of smoothness. This interface region 305 is shown where the polycrystalline diamond layer 303 is joined to the substrate 304. In this embodiment of the invention the non-planar surface is generally hemispheric, although other non-planar surface shapes can enjoy the advantages of the polishing surface improvement of this invention.

Figure 4A:
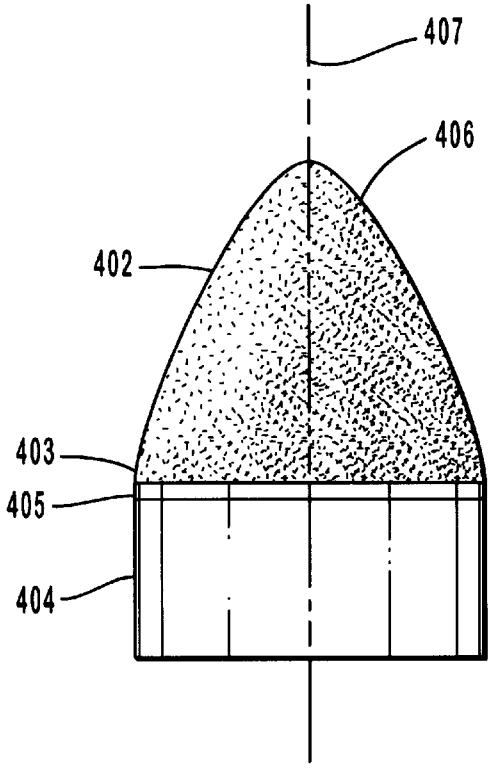
FIG. 4 depicts a second preferred embodiment of the invention showing the polished surface of the diamond insert.
Figure 4B:
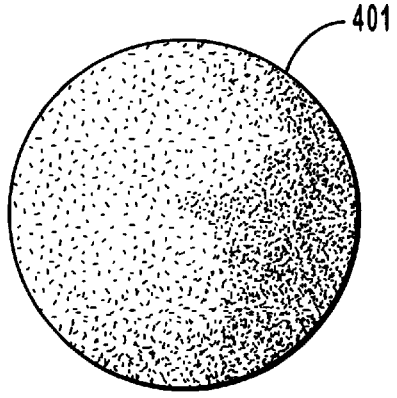

FIG. 4 depicts the top 401 and side 402 view of a second embodiment of the invention. However in this embodiment, the insert substrate 404 is generally cylindrical in shape, while the diamond layer 403 has a conical shape. This diamond insert is composed of a layer of polycrystalline diamond 403 bonded to a tungsten carbide substrate 404. The polycrystalline diamond layer 403 serves as the cutting or contact surface, and is polished to a very high degree of smoothness. The interface region 405 is shown where the polycrystalline diamond layer 403 is joined to the substrate 404.

The described embodiments are to be considered in all respects only as illustrative of the current best mode of the invention known to the inventor and not as restrictive. Although the embodiments shown here have either a hemispherical or conically shaped diamond surface, the polished diamond region, of this invention, is not intended to be limited to any specific non-linear geometry. Moreover, this invention is intended to include combinations of disclosed methods of polishing, for example EDG followed by grinding. The scope of this invention is, therefore, indicated by the appended claims rather than by the forgoing description. All devices which come within the meaning and range of equivalency of the claims are to be embraced within their scope.

I claim:

1. A drilling insert for use on a bit for drilling subterranean formation, comprising:

(A) a substrate having a top surface; and (B) a layer of superabrasive material, having a non-linear shaped interface surface, bonded to said top surface of said substrate and a non-linear shaped contact surface wherein said contact surface is polished to a high degree of smoothness.

2. A drilling insert as recited in claim 1, wherein said substrate is a carbide material selected from the group consisting of tungsten carbide, niobium carbide, zirconium carbide, hafnium carbide, vanadium carbide, tantalum carbide, and titanium carbide.

3. A drilling insert as recited in claim 1, wherein said layer of superabrasive material is composed of polycrystalline diamond.

4. A drilling insert as recited in claim 1, wherein said layer of superabrasive material further comprises: a cutting surface and a center axis.

5. A drilling insert as recited in claim 1, wherein said non-linear contact surface of said layer of superabrasive material is polished by a grinding process.

6. A drilling insert as recited in claim 1, wherein said non-linear contact surface of said layer of superabrasive material is polished by an EDG process.

7. A drilling insert as recited in claim 1, wherein said non-linear contact surface of said layer of superabrasive material is polished by a chemical polishing process.

8. A drilling insert as recited in claim 1, wherein said non-linear contact surface of said layer of superabrasive material is polished by a laser polishing process.

9. A drilling insert as recited in claim 1, wherein said non-linear contact surface of said layer of superabrasive material is polished by a honing process.

10. A drilling insert as recited in claim 1, wherein said layer of superabrasive material is bonded to said substrate by ultra-high pressure sintering.

11. A drilling insert as recited in claim 1, wherein a said layer of superabrasive material is bonded to said substrate by a process of CUP and ultra-high pressure sintering.

12. A drilling insert as recited in claim 1, wherein said layer of superabrasive material is bonded to said substrate by brazing.

13. A drilling insert as recited in claim 1, wherein said layer of superabrasive material is composed of cubic boron nitride.

* * * * *